US006739914B2

(12) United States Patent
Strandfelt

(10) Patent No.: US 6,739,914 B2
(45) Date of Patent: May 25, 2004

(54) PLUG CONNECTOR WITH CENTRAL POLE

(75) Inventor: Bo Strandfelt, Upplands Våsby (SE)

(73) Assignee: Sutars AB, Upplands Vasby (SE)

( * ) Notice: Subject to any disclaimer, the term of this patent is extended or adjusted under 35 U.S.C. 154(b) by 80 days.

(21) Appl. No.: 10/102,950

(22) Filed: Mar. 22, 2002

(65) Prior Publication Data

US 2002/0151223 A1 Oct. 17, 2002

(30) Foreign Application Priority Data

Mar. 28, 2001 (SE) ..... 0101100

(51) Int. Cl.[7] ..... H01R 24/04
(52) U.S. Cl. ..... 439/668; 439/638; 439/814
(58) Field of Search ..... 439/668, 638, 439/956, 824, 482, 819, 34, 36, 814

(56) References Cited

U.S. PATENT DOCUMENTS 3,501,738 A * 3/1970 Tolliver ..... 439/581
3,675,181 A * 7/1972 Lankford et al. ..... 439/581
4,904,213 A * 2/1990 Hock et al. ..... 439/824
5,052,484 A * 10/1991 Gesta ..... 166/55
5,593,323 A 1/1997 Dernehl
5,936,421 A * 8/1999 Stowers et al. ..... 324/761
6,354,882 B1 3/2002 Lindqvist et al.

FOREIGN PATENT DOCUMENTS

WO WO 00/31828 6/2000

* cited by examiner

*Primary Examiner*—Tho D. Ta
*Assistant Examiner*—James R. Harvey
(74) *Attorney, Agent, or Firm*—Birch, Stewart, Kolasch & Birch, LLP

(57) ABSTRACT

An electric plug having a central pole including an axially movable contact rod having a forward portion, and a rear portion, and a radial flange between said forward portion and said rear portion; a connector member for connection of an electrical lead; and a helical first spring received on said rear portion of said contact rod and interposed between said radial flange and said connector member to urge said contact rod in a forward direction, wherein said connector member is provided with a first bore slidingly receiving a rear free end portion, thereby providing slidable electric contact between said end portion and said connector member.

6 Claims, 1 Drawing Sheet

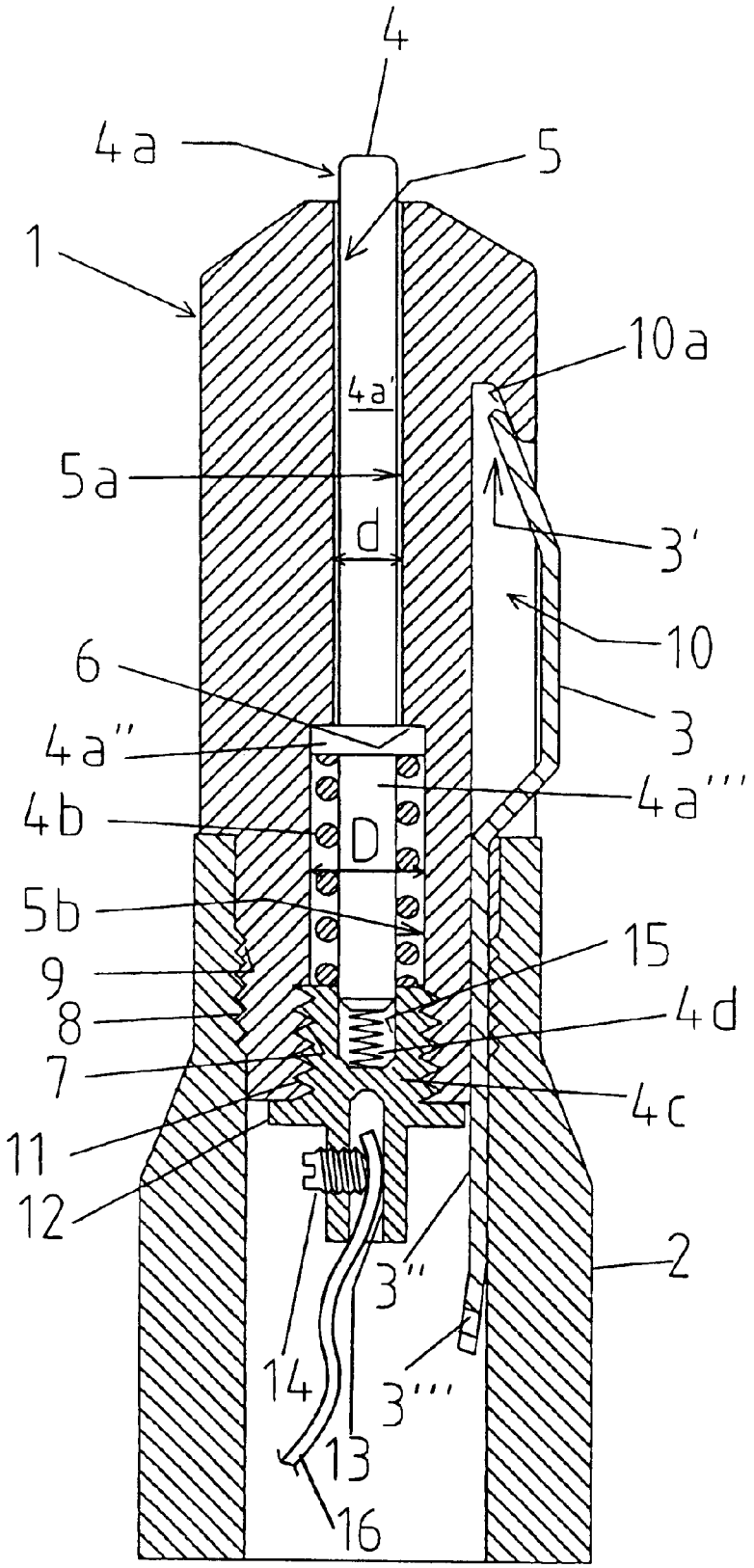
4
4a
5
1
10a
4a'
5a
d
3'
10
6
3
4a''
4a'''
4b
D
5b
15
9
8
4d
7
4c
11
12
2
3''
14
3'''
13
16

PLUG CONNECTOR WITH CENTRAL POLE

FIELD OF THE INVENTION

The present invention concerns an electric plug, particularly of the kind to be used, in a cigarette lighter socket as used in automobiles etc.

BACKGROUND OF THE INVENTION

Such plugs include a peripheral pole (normally minus or ground) and a central pole (normally plus). The peripheral pole is generally a metal wire or strip extending along a substantial portion of the plug length, thereby obtaining a relatively long contact length with the interior of the socket. The central pole is generally a cylindrical contact rod that is spring loaded in order to maintain contact with a plus bottom pole of the socket even in case of smaller axial displacements of the plug. The spring load is generally provided by a compression spring, such as a leaf spring or a helical spring. In use, the electrical current is lead through the spring to a connector member that in turn is connected to an electric lead. This is not a problem in low current applications, such as normal flashlights, radio equipment, tape recorders etc., but when it comes to high current applications, such as winches or powerful flashlights, the current load may lead to overheating of the spring such that it loses its spring properties, or, even melts and breaks the electric circuit.

SUMMARY OF THE INVENTION

The present invention has as its object to provide a new male plug that does not suffer from this drawback. According to the present invention, there is provided an electric plug having a pole including a contact rod having a forward end and a rear end, a connector member and spring means interposed between said contact rod and said connector member to urge said contact rod in a forward direction, wherein said contact rod is provided in its rear end with an axial extension and said connector member is provided with a bore slidingly receiving a rear free end of said extension.

Further scope of applicability of the present invention will become apparent from the detailed description given hereinafter. However, it should be understood that the detailed description and specific example, while indicating a preferred embodiment of the invention, is given by way of example only, since various changes and modifications within the spirit and scope of the invention will become apparent to those skilled in the art from this detailed description.

BRIEF DESCRIPTION OF THE DRAWING

FIG. 1 shows a longitudinal section through a plug according to the present invention.

DETAILED DESCRIPTION OF A PREFERRED EMBODIMENT

The plug consists of a core portion 1 of insulating material, a handle portion 2 of insulating material, a peripheral pole 3 and a central pole 4.

The core portion has a central bore 5 having a first, relatively small diameter din a forward portion 5*a* thereof, and a second, relatively large diameter D in a rear portion 5*b* thereof. A shoulder 6 is formed between the bore portions 5*a* and 5*b*. An internal thread 7 is provided in the rearmost end of the rear bore portion 5*b*. In its rear end, the core portion has a reduced diameter, and an external thread 8 is provided in the rear end thereof.

The handle portion 2 has an annular cross section and an internal thread 9 in its forward end mating the thread 8.

The peripheral pole 3 is a wire or strip of metal partly located in a recess 10 axially extending along a portion of the periphery of the core portion 1. A forward end 3' of the pole 3 is located in an undercut forward end 10*a* of the recess 10, whereas a central portion 10*b* thereof is bent so as to protrude somewhat exteriorly of the periphery of the core portion 1. A rear end 3" of the pole 3 extends along the periphery of the core portion and is kept in place by the handle portion 2 when threaded onto the threads 8. A hole 3'" is provided in the extreme and of the pole 3. The hole may be threaded to receive a non-shown fastening screw for an electric wire, or it may be smooth to receive a wire to be soldered thereto.

The central pole 4 includes a cylindrical metal rod 4*a*, a spring 4*b* and a connector member 4*c*. The spring is shown here to be a helical spring.

The metal rod 4*a* is axially slidable within the bore 2 of the core portion 1. It has a forward portion 4*a'* having a slightly smaller diameter than the diameter $d_1$ of the bore portion 5*a*. The forward portion 4*a'* is terminated by a collar 4*a"* having a diameter slightly smaller than the diameter $d_2$ of the bore portion 5*b*.

The helical spring 4*b* has an outer diameter slightly smaller than the diameter $d_2$ of the bore portion 5*b*. A forward end of the spring abuts the collar 4*a"*, and a rear end thereof abuts the connector member 4*c*.

The connector member 4*c* is a metal body having a forward end having external threads 11 mating with the internal threads 7 of the core portion 1, a flange portion 12 and a rear end having a central bore 13 for receiving an electric wire 16. A stop screw 14 is threaded through the wall of the connector member to keep the electric wire 16 electrically and mechanically connected thereto.

When screwed into the threads 7, the connector member 4*c* partly compresses the helical spring 4*b* so as to resiliently press the flange portion 4*a"* against the shoulder 6 and to allow further compression thereof upon an axial force against the free end of the metal rod 4*a*.

As so far described, the plug substantially corresponds to a state-of-art plug, where a major portion of the current through the plug is transferred through the spring and causes the problems, discussed above.

To solve that problem, the present invention provides a rear portion or extension 4*a'"* of the metal rod 4*a* that may have substantially the same diameter as its forward portion 4*a'*. In its partly compressed state shown, the helical spring 4*b* encloses the extension 4*a'"* and a free, rear end of the latter extends into a bore provided in the connector member 4*c* so as to allow relative sliding motion therebetween, still maintaining a good electrical contact between the extension 4*a'"* and the connector member 4*c*.

As a consequence, the helical spring 4*b* does not have to transfer current through the plug alone any more, since the metal rod 4*a* is a continuous bar extending into the connector member 4*c*. In use, the metal rod 4*a* is likely to be further pressed into the connector member 4*c*, thereby providing an increased contact area between its free end and the bore 15. Naturally, still a portion of the current will be lead through the helical spring abutting the flange 6, at least randomly contacting portions of the metal rod extension 4*a'"*, and contacting the forward end of the connector member 4*c*.

As an alternative to, or, a complement to, what has been described above, a compression spring 4*d* may be located within the bore 15 to be supported by the bottom of the bore and the free end of the extension 4*a*" as shown. Like in the case of the helical spring 4*b*, electrical current is transferred from the metal rod 4*a*', through its extension 4" and into the connector member 4*c* as well as through the spring 4*d*.

The invention being thus described, it will be obvious that the same may be varied in many ways. Such variations are not to be regarded as departure from the spirit and scope of the invention, and all such modifications as would be obvious to one skilled in the art were intended to be included within the scope of the following claims.

What is claimed is:

1. An electric plug having a central pole comprising:

an axially movable contact rod having a forward end portion, and a rear end portion, and a radial flange between said forward portion and said rear portion;

a connector member for connection of an electrical lead; and a helical first spring received on said rear portion of said contact rod and interposed between said radial flange and said connector member to urge said contact rod in a forward direction, wherein said connector member is provided with a first bore slidingly receiving a rear free end portion, thereby providing slidable electric contact between said end portion and said connector member;

wherein the connector member has a forward end with external threads for mating with internal thread of a core portion of the plug.

2. The plug according to claim 1, wherein a second spring is located in said bore to support said rear free end of said rear portion.

3. The plug according to claim 1, including a housing having a bore slidingly receiving said contact rod, said radial flange constituting an abutment limiting movement of said contact rod in said forward direction.

4. The plug according to claim 2, including a housing having a bore slidingly receiving said contact rod, said radial flange constituting an abutment limiting movement of said contact rod in said forward direction.

5. The plug according to having a central pole of claim 1, wherein a bottom of the first bore is closed.

6. The plug according to having a central pole of claim 1, wherein a rear end of the connector member is provided with a central bore.

* * * * *